US005265872A

United States Patent [19]

Tennent et al.

[11] Patent Number: 5,265,872

[45] Date of Patent: Nov. 30, 1993

[54] GOLF CLUB SHAFT HAVING DEFINABLE "FEEL"

[75] Inventors: Richard L. Tennent, Alpine; Richard G. Tennent, Spring Valley; Jerald A. Rolla, Santee, all of Calif.

[73] Assignee: UniFiber USA, Spring Valley, Calif.

[21] Appl. No.: 995,767

[22] Filed: Dec. 23, 1992

[51] Int. Cl.[5] ..... A63B 53/10

[52] U.S. Cl. ..... 273/80 B; 273/DIG. 7; 273/DIG. 23; 273/81 R; 273/80.6

[58] Field of Search ..... 273/80 R, 80 A, 80 B, 273/80 D, 80.1-80.9, 77 R, 77 A, DIG. 7, DIG. 23, 81 R

[56] References Cited

U.S. PATENT DOCUMENTS

| | | | |
|---|---|---|---|
| 1,713,812 | 5/1929 | Barnhart | 273/80 R |
| 1,890,037 | 12/1932 | Johnson . | |
| 2,040,540 | 5/1936 | Young | 273/80.9 |
| 2,086,275 | 7/1937 | Lemmon | 273/80 |
| 2,130,395 | 9/1938 | Lard | 273/80 |
| 2,153,550 | 4/1939 | Cowdery | 273/80 |
| 2,153,880 | 4/1939 | Barnhardt | 273/80 |
| 2,220,429 | 7/1941 | Vickery . | |
| 2,220,852 | 11/1940 | Scott | 273/80 |
| 2,250,428 | 7/1941 | Vickery | 273/80 |
| 3,313,541 | 4/1967 | Benkoczy et al. | 273/DIG. 7 X |
| 3,735,463 | 5/1972 | Merola | 273/80 |
| 4,000,896 | 1/1977 | Lauraitis | 273/80 R |
| 4,157,181 | 6/1979 | Cecka | 273/DIG. 23 X |
| 4,330,126 | 5/1982 | Rumble | 273/80 |
| 4,591,155 | 5/1986 | Adachi | 273/DIG. 23 X |
| 5,156,396 | 10/1992 | Akatsuka et al. | 273/DIG. 23 X |

FOREIGN PATENT DOCUMENTS

| | | | |
|---|---|---|---|
| 3-3251269 | 11/1991 | Japan | 273/80 B |

OTHER PUBLICATIONS

Askeland, Donald R., "The Science and Engineering of Materials", copyright 1984 by Wadsworth Inc. pp. 492-497.

Gill, R. M., *Carbon Fibres in Composite Materials*, (1972) pp. 183-184.

Kelly, A. et al., *Handbook of Composites-vol. 1: Strong Fibres, (1985) pp. 267-272.*

Mallick, P. K., *Fiber-Reinforced Composites: Materials Manufacturing, and Design* (1988) pp. 18-19, 28-35.

*Primary Examiner*—V. Millin

*Assistant Examiner*—Sebastiano Passaniti

*Attorney, Agent, or Firm*—Brown, Martin, Haller & McClain

[57] ABSTRACT

A golf club shaft is described having a "modified hourglass" shape which provides many predetermined combinations of flex, stiffness and torque (which together are perceived as shaft and club "feel") and which is virtually immune to breakage in normal play. The shaft is formed of a base rod with expanded axial sections: a grip section, an upper flare section, a flex control section, a lower flare section, and a hosel section. The lower flare section increases in diameter from its junction with the flex control section to a maximum diameter at its junction with the hosel section, which when the club is assembled is preferably recessed into the club head hosel. Variation of the relative lengths and/or thicknesses of the flex control section and the lower flare section determine the location of the junction between them, and thus the relative amounts of flex, torque and stiffness which produce the feel desired in the shaft. The shafts are formed of composite of polymers (resin) reinforced internally by fibers, preferably carbon fibers.

15 Claims, 1 Drawing Sheet

GOLF CLUB SHAFT HAVING DEFINABLE "FEEL"

BACKGROUND OF THE INVENTION

1. Field of the Invention

The invention herein relates to golf club shafts. More particularly it relates to shafts formed of composites of fiber reinforced resin/polymer.

2. Description of the Prior Art

Golf club shafts made of fiber reinforced resin, particularly resin reinforced with carbon fibers, have been popular for several years. Many players prefer them over the conventional metal shafts. There is commonly a delicate subjective balance among flex, torque and stiffness in a golf club shaft, such that if a player does not think that the balance is "right" the player is not comfortable with the "feel" of the club and finds his or her golf swing impaired to some degree. This is particularly marked with the better players, i.e. those from the professional and low handicap amateur ranks. Such players are extremely demanding about the precise degree of desired flex and stiffness balance in the clubs they use. Since the "right" amount of balance between flex and stiffness is highly subjective to each player, players will commonly use and discard a number of different clubs or sets of clubs seeking to find the set that has a "comfort zone" within which the shaft provides the balance of flex, torque and stiffness with which the player individually feels the most comfortable. Unfortunately, since it has been difficult to obtain the desired balance of flex, torque and stiffness of such composite shafts other than by costly custom design of shafts for individual players, volume manufacturers of shafts have not been able to provide club shafts which would allow for a variety of shafts of different feel on a commercial scale.

Also, a very severe problem with composite resin/fiber shafts has been there tendency to crack or break at the point where the shaft joins the hosel of the club head. In the past, shafts made with a relatively small diameter to provide greater feel also were the most likely to break. This required shaft manufacturers to produce "fat" shafts for added strength, but these bulky shafts are decidedly stiff and do not provide the feel most players want.

Further, the shape of the end of the shaft and its fit with the hosel have been problems. Current shaft designs provide a relatively small contact area between the shaft tip and hosel, so it is difficult to obtain accurate and consistent alignment between the shaft and the club head through the hosel.

It would therefore be of significant advantage to have a fiber reinforced composite golf club shaft design which could be manufactured on a large scale commercial basis, which could be produced in a variety of combinations of flex, torque and stiffness, and which was virtually free of any tendency to break.

SUMMARY OF THE INVENTION

The invention herein is a golf club shaft having a "modified hourglass" shape which provides many predetermined combinations of flex, stiffness and torque (which together are perceived as shaft and club "feel") and which is virtually immune to breakage in normal play. The shaft is formed of a base rod having axial sections of different diameters: a grip section, an upper flare section, a flex control section, a lower flare section, and a hosel section. The flex control section is of the smallest outer diameter, and essentially comprises a portion of the based rod or shaft. The lower flare section increases in diameter from its junction with the flex control section to a maximum diameter at its junction with the hosel section, which when the club is assembled is preferably within the club head hosel. Variation of the relative lengths and/or thicknesses of the flex control section and the lower flare section determine the location of their junction and thus the relative amounts of flex, torque and stiffness to produce the feel desired in the shaft.

More specifically, in its broadest aspect, the invention herein is golf club shaft having a predetermined combination of flex, stiffness and torque and being highly resistant to breakage, and comprising a base rod extending the length thereof and having in adjacent order from top to bottom a grip section, an upper flare section, a flex control section, a lower flare section, and a hosel section; the flex control section comprising a portion of the base rod intermediate the ends thereof; the flare section having varying diameter increasing from the rod diameter at its junction with the flex control section to a greatest diameter at its junction with the hosel section; the hosel section having varying diameter decreasing from that greatest diameter to a lesser diameter at the bottom of the shaft; and the grip section being adapted to receive a hand grip surrounding at least a portion of the outer surface of the grip section; with the relative lengths of the flex control section and the flare section and the location of the junction between them being determined by the relative amounts of flex, torque and stiffness desired in the shaft.

The golf club shafts of this invention are formed of composites of polymers (resins) reinforced internally by oriented fibers, preferably carbon, glass, aramid and extended chain polyethylene fibers. Preferably each section of the shaft is formed of a plurality of layers or plies of these composites, with the direction of alignment of the fibers in one layer differing from the direction of alignment of the fibers in each adjacent layer, to produce enhanced strength to the shaft.

DETAILED DESCRIPTION AND PREFERRED EMBODIMENTS

Figure 1:
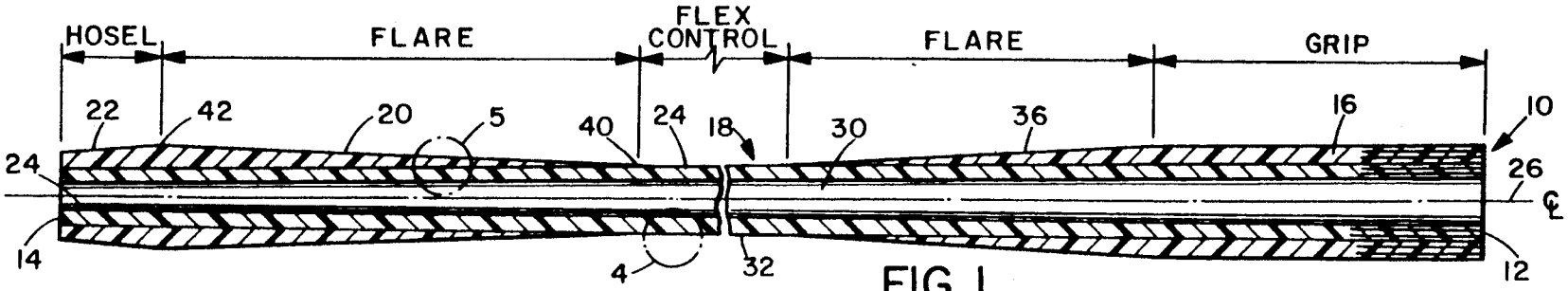
FIG. 1 is an axial cross-sectional view of a shaft structure of the present invention, shown with exaggerated proportions for clarity, and with the various important dimension points and separate sections of the shaft indicated.

The shaft of the present invention, as initially illustrated in FIG. 1, has what may be termed a "modified hour glass" shape. The shaft 10 is in five sections, which as designated from the top or upper (grip) end 12 to the bottom or lower (club head) end 14 of the shaft are respectively the grip section 16, the lower flare section 20, the flex control section 18, the upper flare section 36 and the hosel section 22. While these sections represent slightly different structures physically, it will be understood they are all part of the unitary shaft and that there are no abrupt physical joints between the sections. The sections are designated herein for ease in referring to the different regions of the structure of the present shaft 10, rather than to imply that the shaft 10 itself is formed of separate components which must be joined.

Figure 7:
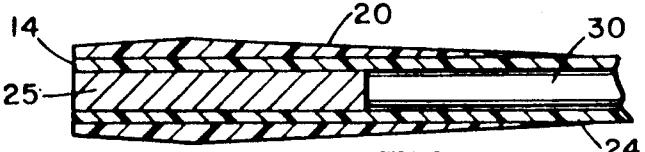
FIG. 7 is an axial cross-sectional view of the lower portion of a shaft similar to that of FIG. 1 in which the lower portion is solid rather than hollow.

The substrate of the shaft 10 is base rod 24 which extends for the length of the shaft 10. Base rod 24 is an elongated rod which is formed about axial centerline 26. It is preferably hollow throughout its length, as indicated in FIG. 1, but if desired (as for weight distribution) either or both the upper and lower portions of the rod 24 may be solid as indicated in FIG. 7. The solid lower portion will start at the lower end 14 but should not extend into the flex control section 18 since such would adversely affect the flex, stiffness and torque of the shaft 10.

The base rod 24 of the shaft 10 will have a slight taper throughout its length, since the interior hollow space 30 must have such a taper to permit withdrawal from the mandrel on which it is formed. The base rod 24 is formed by wrapping successive layers of fiber-reinforced composites until the desired thickness of wall 32 is obtained. Typically a shaft may have 5–25 layers or plies 34 of composites; 10–20 layers is common. As shown in schematic detail in FIG. 4, each successive ply 34 (here designated 34*a*, 34*b* and 34*c*) will normally be laid up in manufacturing so that the orientation of the fiber reinforcement in one layer or ply 34 is at a marked angle to the orientation of the fibers in each of the immediately adjacent layers 34. Typically the angular difference is 30°–90°, although other angular differences may be used. It is also desirable in some cases for successive layers to have parallel orientation. This is particularly true for the outer layers of the shaft.

The average outside diameter of the base rod 24 will be on the order of about 0.375" (1 cm) near the middle of the shaft 10, with a wall 32 thickness of about 0.1" (2.5 mm). It will be recognized that the preferred axial taper of the base rod 24 will result in a slightly greater outside diameter at the upper end 12 and a slightly lesser diameter at the lower end 14, although wall 32 thickness will preferably be constant throughout. Average diameter and/or wall thickness may be varied somewhat if one desires a thicker or thinner shaft.

It will be seen from FIG. 1 that the base rod 24 itself principally makes up flex control section 18. Few additional overwrapping layers are applied to the base rod 24 in this section, and then usually only near the upper end (although there will normally be surface coatings as described below). All of the other sections are then formed by applying overwrapped layers or plies 34 to the outer surface of base rod 24 so that they will have greater average diameters than that of flex control section 18.

Figure 3:
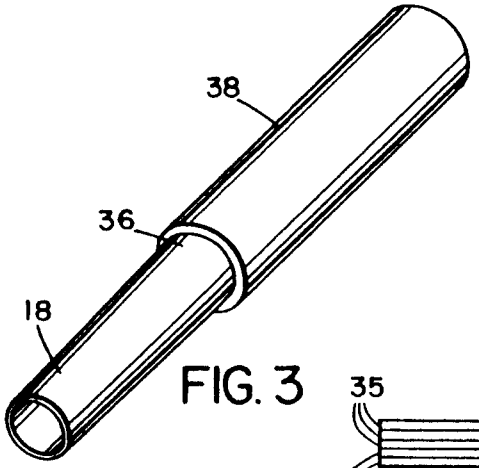
FIG. 3 is a perspective view of the upper portion of a shaft with a grip mounted on it.

Above the flex control section 18 is the grip section 16, which extends to and abuts the upper flare section 36 and continues to the top end 12 of the shaft as either a constant diameter or, as shown in FIG. 1, usually with an tapered outer surface parallel to the outer surface of the base rod 24. This permits a standard club grip 38 to be fitted over the grip section 16 and adhered thereto, as indicated in FIG. 3. The maximum diameter of grip section 16 is limited by the maximum outer diameter of grip 38. The grip 38 must have a diameter large enough, but not too large, to enable a player to comfortably hold and swing the club in the normal manner. Commonly the maximum outer diameter of the grip section 16 will be on the order of about 0.1" to 0.2" (2.5–5.0 mm) greater than the average outer diameter of the base rod 24. Most players' hands are of similar sizes, and the standard outer sizes of golf club grips are well known and need not be detailed here.

A critical element of the shaft of the present invention is the flex control section 18. This may be referred to simply as the "flex point," although it will be recognized that it is an area of length of the shaft 10 and not a single axial point. As will be detailed below, this section 18 can be moved up or down the shaft as the relative lengths of the flex control section 18 and the lower flare section 20 are varied, i.e., as the junction 40 between them is moved.

Figure 6:
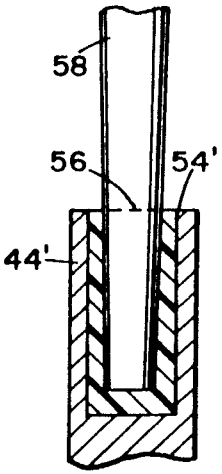
FIG. 6 PRIOR ART
FIG. 6 is a view similar to that of FIG. 2 but illustrating the relation of prior art shafts and club head hosels.

Also critical to the design of the shaft 10 is the outward taper of flare section 20. This is a unique feature of the present shaft 20, since prior art shafts were designed to maintain either an essentially constant diameter or a constant taper from the grip down to the lower end within the club head hosel, as indicated in FIG. 6. In the present structure, however, the flare section 20 has walls which thicken to flare outwardly as indicated in FIG. 1 to the widest point of the shaft, indicated as 42, which is at the junction point of the lower flare section 20 and the hosel section 22. The diameter of the shaft at point 42 is commonly on the order of 0.5" (12 mm) and the taper of the flare section 20 may be a straight taper or a curving taper.

Finally, the hosel section 22 is the portion which is bonded to the hosel 44 of club head 46 as by adhesive 48. This section has a reverse (inward) taper to a diameter at the lower tip 14 of the shaft 10 which is smaller than the diameter at point 24 but greater than diameter of base rod 24 at lower end 14 of the shaft 10. Commonly the outer diameter of the lower end of the hosel section 22 is on the order of approximately 0.4" (1 cm), with the taper being in the range of about 0.7%–1.2%.

The tapered structure of the hosel section 22 and the lower flare section 20, and their relationship to the club head hosel 44, provide several unique and important characteristics to the present shaft 10 which have not been available with the prior art shafts. The widest diameter point 42 can be located at or slightly below the top of the recess 52 in the hosel 44. It is preferred that point 42 be located about 0.1" (2.5 mm) below the top 54.

Having the shaft substantially flared outwardly at point 42 with the point 42 located within the recess 52, makes the shaft 10 virtually free of any tendency to break. In normal use, golf club shafts almost always break at the same location: at the junction 56 with the top 54' of the hosel 44' as indicated in FIG. 6. (Breakage at other points along the shaft length is normally a result of misuse of the club.) This has been a serious problem with the prior art club shafts. As noted, since the prior art shafts have had a constant diameter or taper throughout their length, the only way that the prior art has known to combat this problem has been to thicken the wall of the entire shaft, which has resulted in deterioration of club feel. Since players consider feel to be most important, they have been forced to accept frequent club shaft breakage as a unwelcome detriment of clubs with the desired feel. With the present shafts, however, desirable feel can be obtained with virtually no shaft breakage in normal play.

Further, the greater width of the hosel portion 22 of the shaft 20, as compared to the minimum width of the constant diameter or taper prior art shafts, provides a unique self-aligning ability which causes the hosel section 22 during assembly to assume and maintain a position within the hosel 44 which puts the club head 46 in precise alignment with the shaft 10. Prior art shafts which had much slimmer or much more pointed tips at the hosel end of the shaft permitted a great deal of motion of the club head during assembly, so that consistent alignment has been difficult to obtain and more difficult to maintain during the club's playing lifetime. The present design prevents significant shifting of alignment of the club head during its playing life, such that the player need not compensate for shifting club head angle as the club ages.

The dimensioning of the length of the shaft is of major importance in the performance of the shaft. At the lower end 14, the length of the hosel section 22 is on the order of approximately 1.0" to 1.3" (2.5–3.3 cm). The hosel zone 50 extends about ⅛" (3.2 mm) above and below the top 54 of the hosel 44. This length of the hosel section 22 is more a function of the club head than the shaft, and will be dependent upon the particular club head to be mounted on the shaft.

The length of the grip section 16 and the length of the upper flare portion 36 are also somewhat of a matter of choice, depending on the length of the shaft that is to be designed and the length of the grip to be mounted. Typically the overall length of the grip section 16 will be 12" or more (30 cm or more) while the length of the tapered section 36 will be on the order of about 12"–18" (30–45 cm).

The lengths of the flex control section 18 and the lower flare section 20 and their ratio are critical to the unique properties of the shaft of this invention. The lower flare section 20 is commonly approximately 12"–18" (30–45 cm) in length, and the flex control section is about 6"–12" (15–30 cm) in length. However, the location of junction 40 where they meet can be varied according to the relative degrees of stiffness, torque and flex which are desired. If the location of junction 40 is moved upwardly on the shaft by extending the length of flare section 20 and (usually) also decreasing the length of flex control section 18, the stiffness of the shaft will increase. Conversely, if the location of junction 40 is moved downwardly on the shaft by reducing the length of lower flare section 20 and increasing the length of flex control section 18, the stiffness of the shaft will decrease.

The degrees of flex, torque and stiffness can also be varied by making the base rod 24 (and the flex control section 18) of greater or lesser diameter, by changing the thickness of the shaft wall (for a constant mandrel size). A thicker base rod 24 will be stiffer and less flexible, and vice versa. Similarly, varying the thickness of the lower flare section 20 will have the same result. In either case thickness will be determined by the number of layers or plies 34 used to build up the base rod 24 and/or flare section 20 and their individual thickness.

Thus by simple combinations of the length of the lower flare section 20 with respect to the length of the flex control section 18 and/or the thickness or diameter of either, one can produce a wide range of flex/torque/-stiffness characteristics and readily provide club shafts to precisely meet the specific club characteristics which each individual player seeks.

From a commercial perspective, a vendor can produce shafts of a variety of predetermined ratios of the two sections and their thicknesses/diameters, and thus provide a wide variety of graded degrees of flex/torque/stiffness ratios so that pro shops, golf supply stores, sporting goods stores and the like can readily stock clubs of a variety of precise and predetermined club feels for selection by purchasers.

Figure 4:
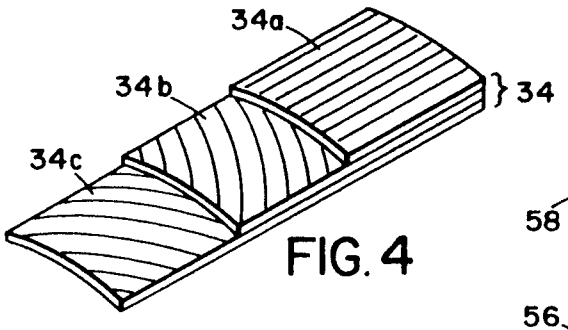
FIG. 4 is a graphical representation in isometric view of the portion of the shaft indicated by the circle 4 in FIG. 1, and showing typical relative orientation of fibers in adjacent plies or layers of composites forming the base rod of the shaft.

The manufacture of the present shafts generally follows conventional fiber composite manufacturing methods, but with certain variations which will be described below. The base rod 24 of the shaft is first laid up around a conventional steel mandrel having an average diameter equal to what will eventually be the average inner diameter of the shaft itself. The mandrel will have a slight taper, in order to facilitate withdrawal of the mandrel from the shaft after forming. The different plies 34*a*, 34*b*, 34*c*, etc. of the fiber reinforced composite are laid up in sequence with the resin matrix in a flexible beta stage. As illustrated in FIG. 4, the composite plies 34 will be laid up with any desired combination of axial orientation (longitudinal of the shaft), radial orientation (circumferential of the shaft) and bias orientation (fiber orientation at an angle between the radial and axial orientations) between adjacent layers. Commonly the bias fiber orientation is on the order of 30° to 90° to the axis of the shaft. Commonly any particular cross section of a fiber reinforced composite base rod 24 will have at least two different fiber orientations to provide structural integrity. The outermost layers are usually laid up with parallel (0° ) orientation to the shaft axis.

Figure 5:
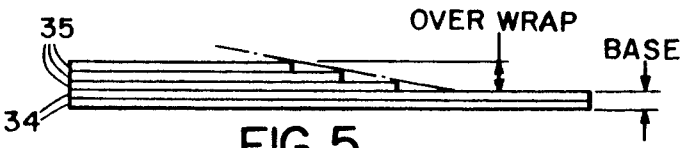
FIG. 5 is a graphical representation in isometric view of the portion of the shaft indicated by the circle 5 in FIG. 1, and showing typical relative orientation of fibers in adjacent plies or layers of composites forming an expanded section (in this case the flare section) of the shaft.
Figure 2:
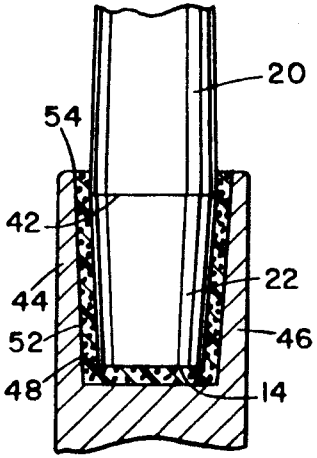
FIG. 2 is a side elevation view partially in cross-section, of the lower end of a shaft inserted into the hosel of a club head.

To produce the shafts of this invention, the production process must differ substantially from the lay-up processes used for production of prior art shafts, with their straight or constant taper shapes. Such prior art lay-up processes involved only a single lay-up step equivalent to the base rod lay-up described in the preceding paragraph. In the present invention, however, the flare sections 20 and 36, the hosel section 22 and preferably also the grip section 16 are formed by having additional plies 35 and laid up as overlay around the base rod 24 shaft, as illustrated in FIG. 5. This produces the opposite tapers and the "modified hourglass" shape of the shaft 10 as illustrated in FIGS. 1 and 2. Where there is to be a taper, the plies are cut in triangular shape; turning the triangular plies in the opposite direction at the junction of the hosel section 22 and the flare section 20 creates the reverse taper for the hosel section 22. For parallel wrap rectangular or square cut shapes will be used. Also, while it is most convenient to use overwraps onto the base wall 32, it is also possible (but not preferred) to have some underwraps laid on the mandrel prior to lay-up of the base shaft 24; this will result is a bulge in the shape of the base shaft 24 where the ultimate outward flares are to be.

The location of the junction 40 is, as noted, a function of the relative lengths of flex control section 18 and lower flare section 20, and is determined for each individual shaft 10 by the point at which the triangular plies forming the lower flare section 20 begin. Thus precise positioning of the upper end of the triangular plies 35 forming the lower flare section 20 is important so that the desired feel will be obtained in the finished shaft.

Once the fiber-reinforced composite layers 34 and 35 are laid up to the desired thicknesses of each section and portion of each section, the entire shaft 10 is baked in a curing oven to cure the beta stage polymer in the composite and form a hard matrix of solid polymer in which the reinforcing fibers are securely fixed. During cure the polymer will normally flow to fill in any interstices in the matrix and to forms a relatively smooth outer surface for the club. The exact curing temperature and cure time for the oven cure will be functions of the particular polymer (or polymer mixture) being used in the composite. Curing temperatures and times are widely known and published for the polymers useful in this invention. As is well known, there is an inverse relationship between time and temperature; higher temperatures require shorter cure times and vice versa. One skilled in the art can readily determine the optimum time and temperature values for the particular polymer being used and the shaft dimensions, to produce full or limited cure of the polymer.

Once the polymer cure is completed, the shaft is removed from the curing over and allowed to cool. Thereafter it is usually machined (normally by sanding or grinding) to smooth the shaft surface and then finished by buffing and polishing of the surface to remove any remaining slight surface imperfections and to produce a highly attractive club shaft.

If desired, one can thereafter add additional wraps or coatings to the shaft's outer surface to impart colors, design patterns or the like to the shaft in any one or more of the sections, and produce attractive colored, logoed or patterned club shafts. Recently such colored and patterned shafts have become quite popular, particularly outside the United States. It is also possible to add a textured coating material one or more areas of the surface of the shaft, although it is preferred to retain a smooth untextured surface. Typically the shaft is finished by having applied a "clear coat" finish, such as a clear polyurethane, for maximum durability and resistance to weather and sun.

Shafts are normally subjected to typical quality control tests to confirm the flex, torque and stiffness characteristics, as well as to measure any other properties which the manufacturer or vendor believes to be significant. Finally, it is common to coat the shafts with a peelable protective coating, such as a clear plastic film, to protect the shafts during shipping to the club manufacturers.

The materials from which the shafts of the present invention are made will be any of the well-known reinforcing fibers and resin materials for the composites. The preferred fibers for reinforcement are the carbon, glass, aramid and extended chain polyethylene fibers, most preferably the carbon fibers. (As used herein, the term "carbon fibers" encompasses all carbon-based fibers, including "graphite fibers.") Reinforcement fibers are available commercially from a variety of sources and under numerous different trade names, including "Kevlar" TM for aramid fibers and "Spectra" TM for extended chain polyethylene fibers. These fibers, and their use as resin reinforcements, are widely described in the literature; one comprehensive source is Rubin (ed.), *Handbook of Plastic Materials and Technology,* chapters 70–77 (Wiley Interscience: 1990). Other sources include, for carbon fibers, Matlick, *Fiber-Reinforced Composites: Materials, Manufacturing, and Design* (Marcel Decker, N.Y.: 1988); Gill, *Carbon Fibres in Composite Materials* (Iliffe Books, London: 1972) and Watt et al., *Handbook of Composites—Volume 1: Strong Fibres* (Elsevier Science Publ., N.Y.: 1985), and for other fibers, including glass and aramid, *Modern Plastics Encyclopedia* 88, 64, 10A, 183–190 (1987). Typical of the resins which may be used are thermosetting resins or polymers such as the phenolics, polyesters, melamines, epoxies, polyimides, polyurethanes and silicones; the properties and methods of manufacture of these polymers are also described in the previously mentioned *Handbook of Plastic Materials and Technology* and *Modern Plastics Encyclopedia* 88. London: 1972) and Watt et al., Strong Fibers (Elsevier Science Publ., N.Y: 1985), and for other fibers, including glass and aramid, Modern Plastics Encyclopedia 88, 64, 10A, 183–190 (1987). Typical of the resins which may be used are thermosetting resins or polymers such as the phenolics, polyesters, melamines, epoxies, polyimides, polyurethanes and silicones; the properties and methods of manufacture of these polymers are also described in the previously mentioned *Handbook of Plastic Materials and Technology* and Modern Plastics Encyclopedia 88.

The shafts of the present invention have highly desirable properties because of the unique modified hourglass shape. Not only do they have a very striking visual impact, but the structure allows for dampening of the various vibrational harmonics that are created during a golf swing, allowing one to optimize the feel characteristics of the club with respect to the player's individual swing characteristics. The shafts has good bending strength, high durability and, as noted, are so resistant to breakage, especially at the top of the club hosel, as to virtually eliminate the possibility of breakage during normal golf play.

It will be evident from the above that there are numerous embodiments of the present invention which while not expressly set forth above, are clearly within the scope and spirit of the invention. The above description is therefore intended to be exemplary only, and the full scope of the invention is to be defined solely by the appended claims.

We claim:

1. A golf club shaft having a predetermined combination of flex, stiffness and torque and being highly resistant to breakage, comprising:

a base rod having opposite ends having in adjacent order from top to bottom a grip section, an upper flare section, a flex control section, a lower flare section, and a hosel section;

said flex control section comprising a portion of said base rod intermediate the ends thereof;

said lower flare section having varying diameter increasing from the rod diameter at its junction with said flex control section to a greatest diameter at its junction with said hosel section;

said hosel section having varying diameter decreasing from said greatest diameter at its junction with said lower flare section to a lesser diameter at the bottom of said rod; and said grip section being adapted to receive a hand grip surrounding at least a portion of an outer surface of said grip section;

said base rod being formed of a composite of a polymer reinforced internally by at least one set of elongated parallel aligned fibers disposed in a first plurality of layers and each of said grip, flare and hosel sections having at least one additional fiber reinforced composited layer disposed over an outer surface of said first plurality of layers; and the relative lengths of said flex control section and said lower flare section and the location of said junction therebetween being determined by the relative amounts of flex, torque and stiffness desired in said shaft.

2. A golf club shaft as in claim 1 wherein at least a portion of the length of said base rod is hollow.

3. A golf club shaft as in claim 2 wherein said rod is hollow throughout its entire length.

4. A golf club shaft as in claim 1 wherein said base rod has a varying diameter and tapers from a greater diameter at its top to a lesser diameter at its bottom.

5. A golf club shaft as in claim 4 wherein said taper is straight.

6. A golf club as in claim 1 wherein the diameter of said shaft at the junction of said lower flare section and said hosel section is the largest diameter of said shaft.

7. A golf club shaft as in claim 1 wherein the direction of alignment of fibers in at least one of said layers differs from the direction of alignment of the fibers in an adjacent layer.

8. A golf club shaft as in claim 1 wherein adjacent pairs of layers at and proximate to the inner diameter of said shaft have different fiber orientation and adjacent layers at and proximate to the outer diameter of said shaft have parallel fiber orientation.

9. A golf club shaft as in claim 1 wherein each of said grip, flare and hosel sections is formed by wrapping an additional plurality of fiber reinforced composite layers over the outer surface of said first plurality of layers.

10. A golf club shaft as in claim 9 wherein the direction of alignment of fibers in at least one of said layers differs from the direction of alignment of the fibers in an adjacent layer.

11. A golf club shaft as in claim 1 wherein the number of layers in each said additional plurality of layers at each axial point in each said section determines the outer diameter of said section at said axial point.

12. A golf club shaft as in claim 1 wherein said polymer comprises a thermoset polymer.

13. A golf club shaft as in claim 12 wherein said fiber reinforcement is selected from the group consisting of carbon, glass, aramid and extended chain polyethylene fibers.

14. A golf club shaft as in claim 13 wherein said fiber reinforcement is carbon fibers.

15. A golf club shaft as in claim 13 wherein said fiber reinforcement is glass fibers.

* * * * *